US009326600B1

(12) United States Patent
Reynolds

(10) Patent No.: US 9,326,600 B1
(45) Date of Patent: May 3, 2016

(54) SHELVING AND METHOD

(71) Applicant: Margaret M. Reynolds, High Point, NC (US)

(72) Inventor: Margaret M. Reynolds, High Point, NC (US)

( * ) Notice: Subject to any disclaimer, the term of this patent is extended or adjusted under 35 U.S.C. 154(b) by 169 days.

(21) Appl. No.: 14/069,647

(22) Filed: Nov. 1, 2013

(51) Int. Cl.

| | |
|---|---|
| ***A47F 5/08*** | (2006.01) |
| ***A47B 47/00*** | (2006.01) |
| *A47B 96/02* | (2006.01) |
| *A47B 57/06* | (2006.01) |
| *A47B 96/06* | (2006.01) |

(52) U.S. Cl.
CPC ..... *A47B 47/00* (2013.01); *A47B 57/06* (2013.01); *A47B 96/027* (2013.01); *A47B 96/067* (2013.01)

(58) Field of Classification Search
CPC ..... A47B 47/00; A47B 57/06; A47B 96/027; A47B 96/067
USPC ..... 211/90.01, 90.02, 90.04, 87.01, 103, 211/186–188, 190–192, 194; 248/558, 248/122.1, 241, 244; D25/712, 126, 129, D25/131; 108/180, 186, 187
See application file for complete search history.

(56) References Cited

U.S. PATENT DOCUMENTS

| | | | | | |
|---|---|---|---|---|---|
| 1,687,671 | A | * | 10/1928 | June | 108/186 |
| 3,009,582 | A | * | 11/1961 | Degener | 211/191 |
| 3,095,975 | A | * | 7/1963 | Cassel et al. | 211/192 |
| 3,199,471 | A | * | 8/1965 | Orsi | 108/187 |
| 3,207,322 | A | * | 9/1965 | Pedersen | 211/190 |
| 3,228,646 | A | * | 1/1966 | Lane et al. | 248/354.3 |
| 3,351,212 | A | * | 11/1967 | McConnell | 211/192 |
| 3,534,517 | A | * | 10/1970 | Kann | 52/239 |
| 3,561,608 | A | * | 2/1971 | Weider | 211/191 |
| 3,637,087 | A | * | 1/1972 | Denny | 211/192 |
| 3,647,080 | A | * | 3/1972 | Denny | 211/191 |
| D223,400 | S | * | 4/1972 | Selden | D25/127 |
| 3,771,466 | A | * | 11/1973 | Ferdinand et al. | 108/109 |
| 3,802,574 | A | * | 4/1974 | Weider | 211/134 |
| 3,891,189 | A | * | 6/1975 | Russo | 256/1 |
| 3,892,189 | A | * | 7/1975 | Killam | 108/109 |
| 3,905,483 | A | * | 9/1975 | Patrick | 211/190 |
| 3,906,872 | A | * | 9/1975 | Erickson | 108/92 |
| D240,362 | S | * | 6/1976 | Russo | D25/131 |
| 3,963,290 | A | * | 6/1976 | Rennemann | 312/321 |
| 4,048,059 | A | * | 9/1977 | Evans | 108/155 |
| 4,078,664 | A | * | 3/1978 | McConnell | 211/189 |
| 4,086,857 | A | * | 5/1978 | Igarashi et al. | 108/106 |
| 4,088,229 | A | * | 5/1978 | Jacoby et al. | 211/191 |
| 4,379,430 | A | * | 4/1983 | Ruschitzka | 108/107 |
| 4,528,915 | A | * | 7/1985 | Cofer | 108/108 |
| 4,815,613 | A | * | 3/1989 | Hollander | 211/191 |
| 4,919,280 | A | * | 4/1990 | Phillips | 211/87.01 |
| 5,326,204 | A | * | 7/1994 | Carlson et al. | 410/143 |

(Continued)

OTHER PUBLICATIONS

"The Specification Guide" (sixteen (16) pages) downloaded from rakks.com showing various shelving system components and configurations; copyright 2011 Rangine Corporation.

*Primary Examiner* — Joshua J Michener
*Assistant Examiner* — Devin Barnett
(74) *Attorney, Agent, or Firm* — Blake P. Hurt; Tuggle Duggins P.A.

(57) ABSTRACT

Shelving is provided which is easy to assemble and will fit a variety of spaces. Lateral members of various lengths and widths are connected to elongated extruded stanchions to form different shelving configurations. While bracing and adjustable feet make the shelving suitable for many applications such as with uneven floors, walls and ceiling heights.

10 Claims, 5 Drawing Sheets

(56) References Cited

U.S. PATENT DOCUMENTS

| | | | | |
|---|---|---|---|---|
| 5,443,167 | A * | 8/1995 | Menaged et al. | 211/106.01 |
| 5,495,952 | A * | 3/1996 | Kainz | 211/90.04 |
| 5,547,088 | A * | 8/1996 | Belokin et al. | 211/87.01 |
| 5,577,623 | A * | 11/1996 | Bustos | 211/187 |
| 5,584,624 | A * | 12/1996 | DeVoursney | 410/143 |
| 5,632,389 | A * | 5/1997 | Rosenband | 211/187 |
| 5,642,675 | A * | 7/1997 | Webb | 108/48 |
| D382,736 | S * | 8/1997 | Kopish | D25/126 |
| 5,788,093 | A * | 8/1998 | Krut | 211/119 |
| 5,833,084 | A * | 11/1998 | Chang | 211/187 |
| 6,082,560 | A * | 7/2000 | Timm | 211/90.01 |
| 6,123,033 | A * | 9/2000 | Polley et al. | 108/107 |
| 6,152,314 | A * | 11/2000 | Besanko et al. | 211/134 |
| 6,286,691 | B1 * | 9/2001 | Oberhaus et al. | 211/118 |
| D453,045 | S * | 1/2002 | Ohanesian | D25/124 |
| 6,364,138 | B1 * | 4/2002 | Chen | 211/187 |
| 6,682,253 | B2 * | 1/2004 | Binna et al. | 403/263 |
| 6,877,826 | B2 * | 4/2005 | Wood et al. | 312/205 |
| 7,165,690 | B2 * | 1/2007 | Wu | 211/192 |
| 7,673,762 | B2 * | 3/2010 | Humberto | 211/186 |
| 7,681,851 | B1 * | 3/2010 | Osterholt et al. | 248/308 |
| 7,832,570 | B1 | 11/2010 | Reynolds | 211/103 |
| 8,028,846 | B2 * | 10/2011 | Peota et al. | 211/187 |
| D648,159 | S * | 11/2011 | Hense et al. | D6/712 |
| 8,118,181 | B2 * | 2/2012 | Shinozaki | 211/187 |
| D662,229 | S * | 6/2012 | Williams | D25/126 |
| 8,267,262 | B2 * | 9/2012 | Thelwell | 211/183 |
| 8,561,820 | B2 * | 10/2013 | Kitt et al. | 211/187 |
| 8,967,402 | B2 * | 3/2015 | Pintur | 211/204 |
| 2002/0030027 | A1 * | 3/2002 | Welsch | 211/90.02 |
| 2002/0139766 | A1 * | 10/2002 | Courtwright | 211/191 |
| 2003/0010740 | A1 * | 1/2003 | Konstant | 211/189 |
| 2005/0098403 | A1 * | 5/2005 | McIntyre | 190/110 |
| 2006/0054577 | A1 * | 3/2006 | Strating et al. | 211/87.01 |
| 2006/0091088 | A1 * | 5/2006 | McCoy | 211/60.1 |
| 2007/0215768 | A1 * | 9/2007 | Winig et al. | 248/220.22 |
| 2007/0227989 | A1 * | 10/2007 | Schneider et al. | 211/85.7 |
| 2008/0047474 | A1 * | 2/2008 | Scholz | 108/180 |
| 2008/0314850 | A1 * | 12/2008 | Haarmann | 211/90.02 |
| 2009/0108160 | A1 * | 4/2009 | Kluge et al. | 248/308 |
| 2010/0193455 | A1 * | 8/2010 | Russell et al. | 211/90.02 |
| 2011/0049074 | A1 * | 3/2011 | Woolard | 211/191 |
| 2011/0253659 | A1 * | 10/2011 | Jarvis et al. | 211/153 |
| 2011/0266237 | A1 * | 11/2011 | Artigues et al. | 211/90.02 |
| 2012/0085721 | A1 * | 4/2012 | Michael J. et al. | 211/103 |
| 2012/0160683 | A1 * | 6/2012 | Ye et al. | 204/456 |
| 2012/0187065 | A1 * | 7/2012 | Song | 211/191 |
| 2012/0298607 | A1 * | 11/2012 | Chen | 211/186 |
| 2013/0213918 | A1 * | 8/2013 | Doyle et al. | 211/187 |

* cited by examiner

SHELVING AND METHOD

FIELD OF THE INVENTION

The invention herein pertains to shelving and particularly pertains to shelving which can be assembled on site in a variety of heights and widths as required using extruded aluminum stanchions and lateral sections which are easily attached.

DESCRIPTION OF THE PRIOR ART AND OBJECTIVES OF THE INVENTION

Adjustable shelving has been used for many years in a wide number of configurations. Conventional shelving often has to be made for assembly on site due to particular conditions and individual requirements. Standard wood and other materials that can be cut on site are often employed. Power saws, hammers, electric screw drivers and other tools are usually required to complete an installation. Such shelving can be custom made, however skilled craftsman are usually needed to complete the assembly. Various preassembled shelving is also available which can be completed on site but usually limits the user to a preset design.

Thus, in view of the problems and disadvantages associated with prior art shelving, the present invention was conceived and one of its objectives is to provide shelving which can be installed by an individual worker using only simple hand tools and without requiring any cutting or bending.

It is another objective of the present invention to provide shelving which can be easily adjusted for fitting within a particular room, even one with uneven walls, ceiling or floor.

It is still another objective of the present invention to provide shelving which can be purchased with various components and can later be expanded or modified should the user's needs change.

It is yet another objective of the present invention to provide shelving having extruded stanchions with U-shaped serrated channels for engaging threaded members of either flat or L-shaped supports.

It is a further objective of the present invention to provide shelving having lateral members consisting of a series of U-shaped sections which can be joined by clips for the desired shelf width.

It is still a further objective of the present invention to provide a method of shelf installation and assembly which is both easy and efficient.

Various other objectives and advantages of the present invention will become apparent to those skilled in the art as a more detailed description is set forth below.

SUMMARY OF THE INVENTION

The aforesaid and other objectives are realized by providing shelving having a series of vertical stanchions with a plurality of lateral members attached thereto as needed to contain boxes, books, TVs, or other selected articles. The stanchions can be spaced apart and attached to a vertical wall or ceiling using braces and wall brackets. Lateral members are then attached to the stanchions with either L-shaped or flat supports, depending on the desired shelving configuration. Each stanchion can receive a threaded adjustable foot to insure the shelving is level, for example on old, broken or uneven floors. The elongated vertical stanchions include a relatively thick central section having opposing ridges formed on the ends thereof. T-sides are opposingly positioned on the central section with the T-sides somewhat thinner than the central section. Opposing U-shaped channels are formed between each T-side and the central section of the elongated stanchion to allow secure engagement of threaded members therein. To provide a finished shelf appearance, side face plates can be attached to the lateral members which are formed from a series of U-shaped lateral sections joined together. The lateral members are supported by L-shaped supports affixed to opposing stanchions or by flat supports, also attached to the elongated stanchions to form load bearing surfaces for various objects such as books or other articles.

In the method of use, a site is selected in a room or building and then, stanchions of desired length having adjustable feet are vertically placed on the floor. At the top of the stanchions wall braces are attached to the stanchions and a selected wall using brackets. The stanchions could alternatively be attached to the ceiling if desired. Additional vertical stanchions are likewise attached at selected distances as desired and thereafter a designated number of lateral members are positioned between the stanchions using appropriate threaded members and simple hand tools. The constructed shelving is then ready for use such as for displaying a TV, DVDs, books, figurines, or the like. Multiple shelving designs can be chosen or later varied depending on the user's needs at that time.

DETAILED DESCRIPTION OF THE PREFERRED EMBODIMENT AND OPERATION OF THE INVENTION

Figure 1:
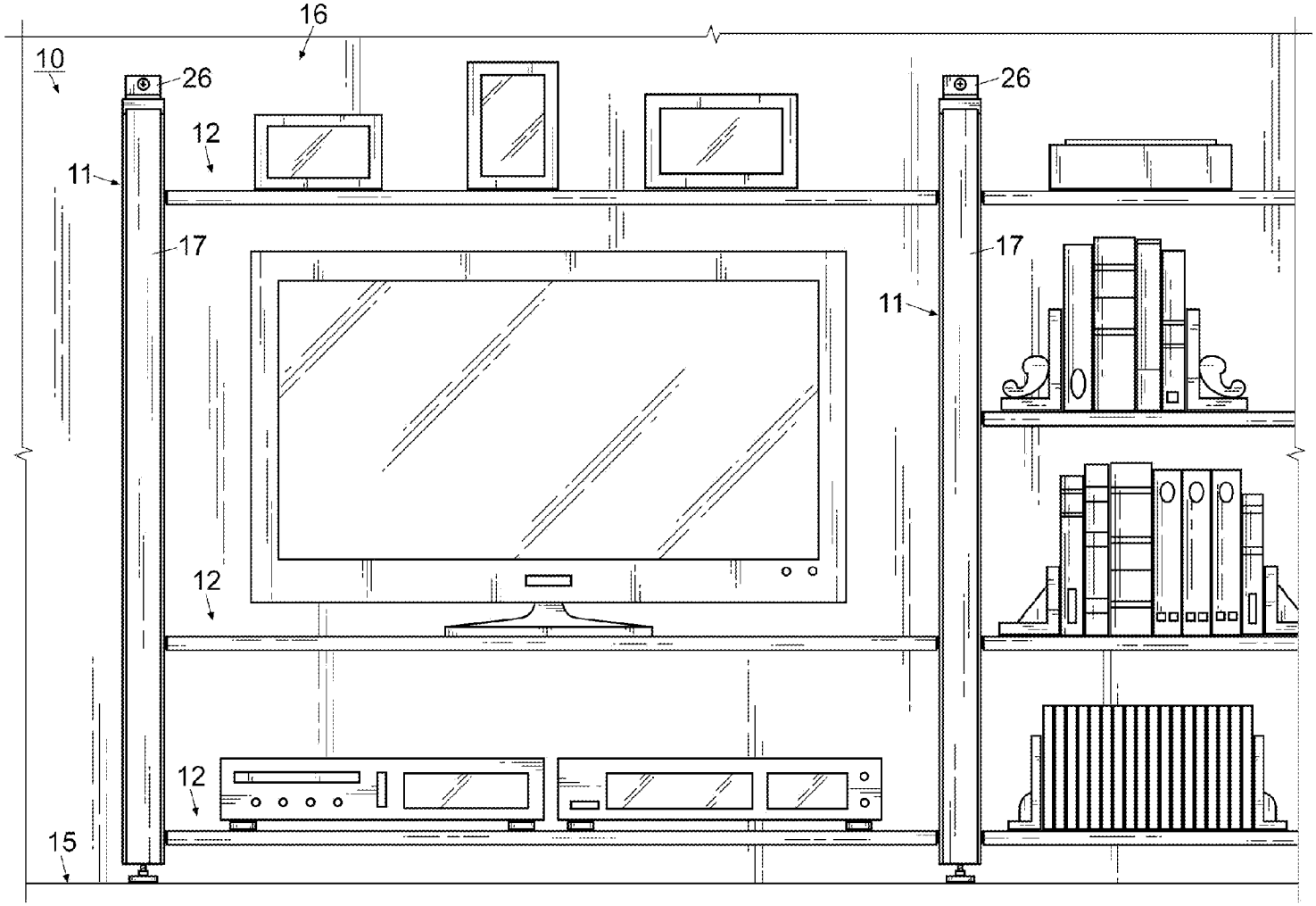
FIG. 1 shows a typical shelving design in fragmented fashion as attached to a typical wall and floor.
Figure 2:
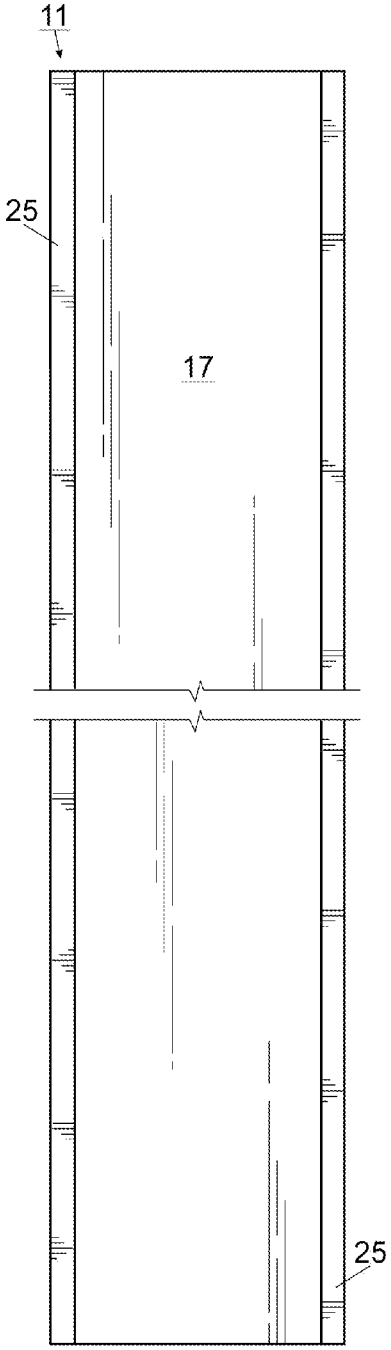
FIG. 2 schematically pictures a stanchion of indeterminate length in a fragmented front elevational view, the rear elevational view being a mirror image thereof.
Figure 3:
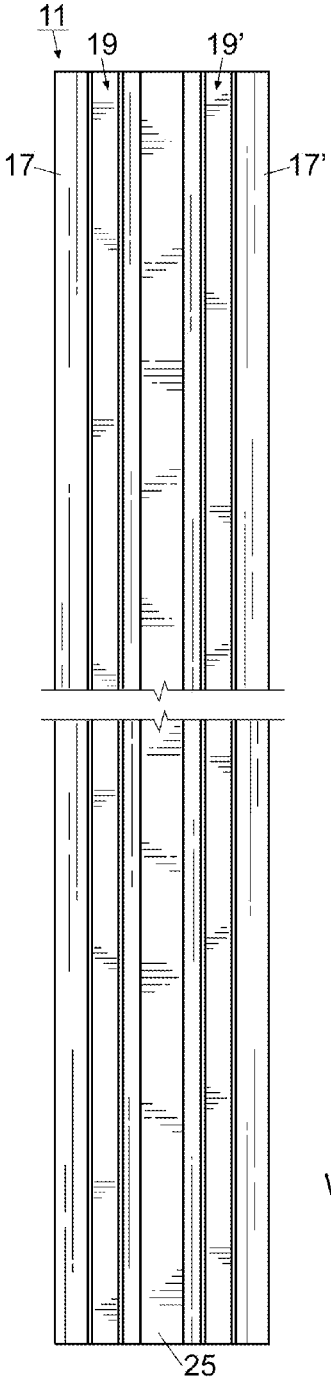
FIG. 3 depicts the stanchion of FIG. 2 in a fragmented right side elevational view, the left side elevational view being a mirror image thereof.

For a better understanding of the invention and its operation, turning now to the drawings, FIG. 1 shows a front elevational view of preferred shelving 10 in a typical assembly with lateral members 12 extending horizontally between elongated vertical stanchions 11. Shelving 10 is positioned on floor 15 and is connected to rear wall 16 as shown therein with a TV, books and other articles positioned thereon.

Figure 4:
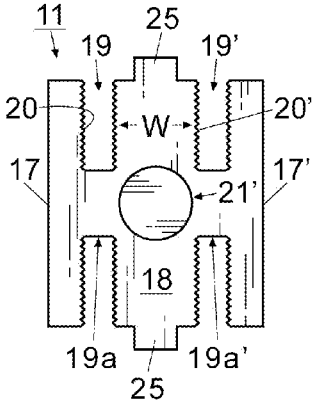
FIG. 4 demonstrates a top plan view of the stanchion as shown in FIGS. 2 and 3.
Figure 5:
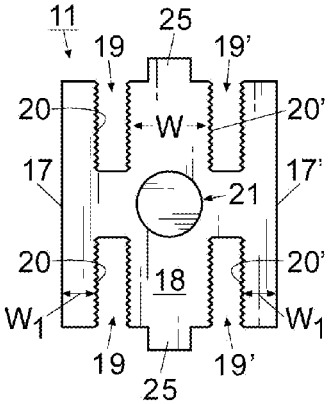
FIG. 5 illustrates a bottom plan view of the stanchion as shown in FIG. 4.

As shown in FIGS. 1-7 preferred elongated stanchions 11 consist of aluminum extrusions which can be manufactured and sold in any increment from one inch (1") to twelve feet (12') such as for example six, eight and ten feet (6', 8', 10') or other lengths as demanded by the purchaser. Other suitable metals such as steel, copper or brass, woods, plastics or composites may also be used but are not preferred. As seen in the end views in FIGS. 4 and 5, stanchion 11 is formed having a central section 18 with a pair of T-sides 17, 17' opposingly joined thereto. Opposing pairs of U-shaped channels 19, 19' are formed between T-sides and central section 18 as shown in FIGS. 4 and 5. Serrations or teeth 20, 20' are formed along the inner walls of U-shaped channels 19, 19' respectfully and act as threaded channels for receiving and holding threaded members 41 therein.

Central section 18 has a width W which is about twice the width or thickness ($W_1$) of T-sides 17, 17' for strength and rigidity. T-sides 17, 17' may be one quarter inch (¼") in thickness ($W_1$) whereas central section 18 has a thickness W of about one half inch (½"). Opposing ridges 25 are formed on each end of central section 18 and extend the length of central section 18 outwardly from central section 18 and T-sides 17, 17'. Ridges 25 help increase the structural integrity of the assembled shelving as notches 31*a* and 32*a* of respectively flat support 31 and L-shaped support 32 engage ridges 25 as shown in FIGS. 6 and 7 and as described in more detail below.

Figure 6:
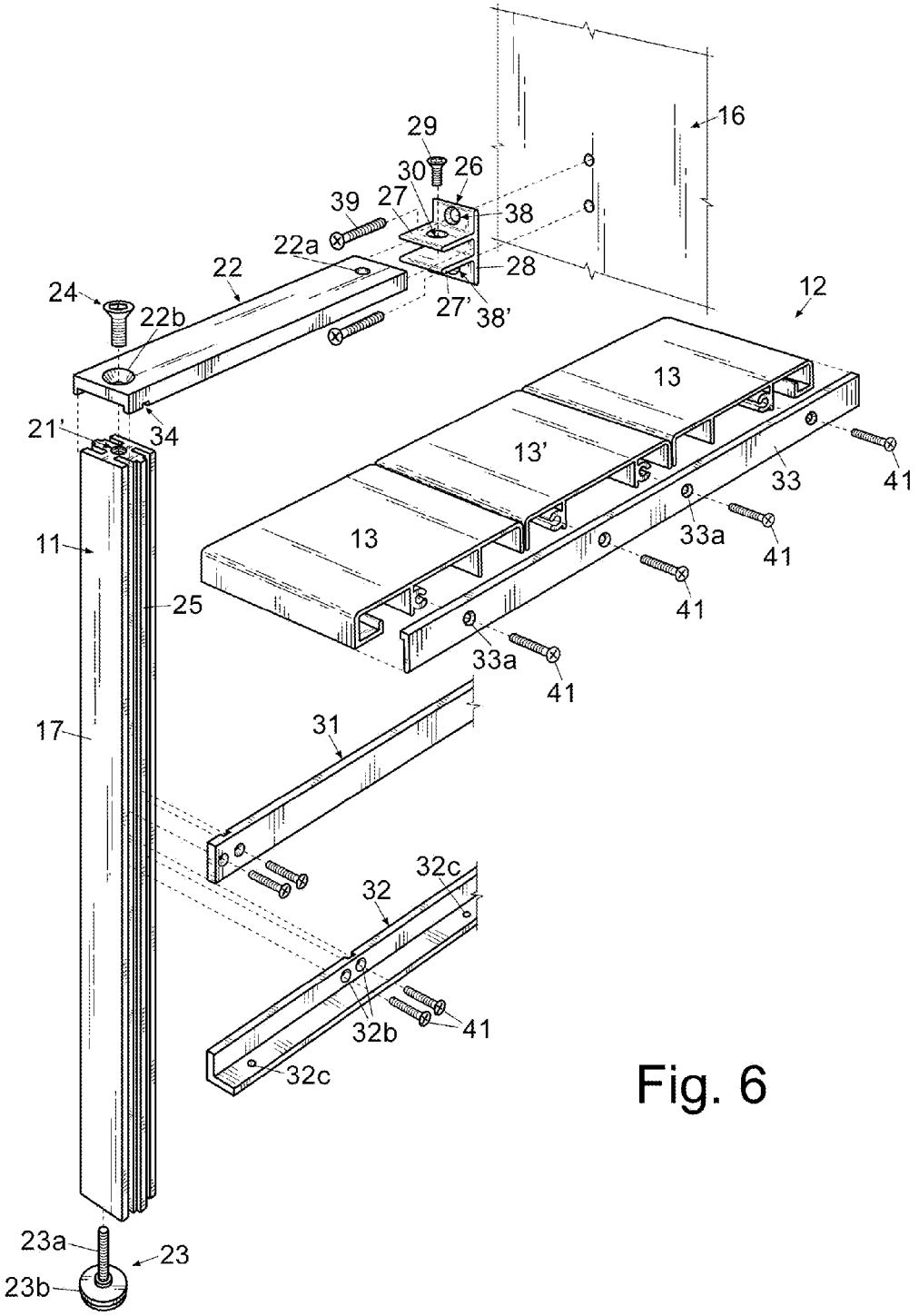
FIG. 6 features a selected stanchion in a top, front, right side perspective fashion with various shelving components exploded therefrom.
Figure 7:
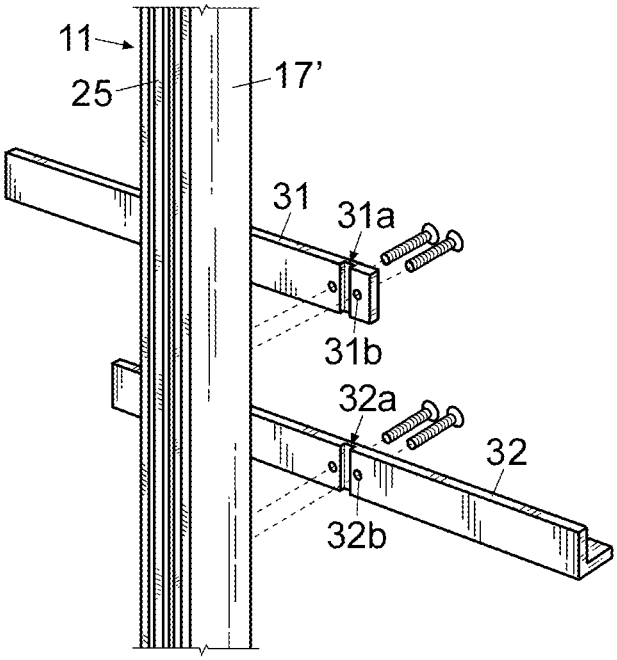
FIG. 7 shows an enlarged view of a section of the stanchion seen in FIG. 6 with shelf supports exploded therefrom.

As shown in FIGS. 4 and 5, threaded openings 21, 21' are centered in the ends of central section 18 for use in attachment of wall brace 22 using screw 24 in opening 21' as shown in FIG. 6 and adjustable foot 23 in opening 21'. Openings 21, 21' are, for example one inch (1") in depth, but may be deeper or shallower as desired. Other embodiments may not include openings 21, 21'. Adjustable leveling foot 23 includes threaded shaft 23*a* and circular base 23*b*. Circular base 23*b* is formed from nylon or other durable materials. Opening 21' in the top of stanchion 11 has a larger threaded diameter than opening 21 but could be the same diameter or smaller if desired. As would be understood threaded shaft 23*a* is threadably received within opening 21 whereby circular base 23*b* rests on floor 15. Adjustable foot 23 can be manually adjusted as needed during assembly for leveling of shelving 10.

During the method of assembly of shelving 10 as shown in FIG. 1, elongated stanchions 11 of a desired length are selected and affixed to wall 16 by attaching wall bracket 26 with standard wood screws 39 as also seen in FIG. 6 into studs or with anchors into dry wall (not shown). Wall bracket 26 includes a vertical rectangular base 28 with a pair of projections 27, 27' spaced apart and extending in a horizontal, parallel posture therefrom. Wall bracket 26 includes a pair of openings 38, 38' formed proximate the opposing ends of base 28 for attachment to wall 16 such as by fasteners 39. Opening 30 is provided in upper projection 27 for reception of screw 29 as shown in FIG. 6 to affix wall brace 22 thereto. Wall brace 22 is U-shaped and includes aperture 22*a* on the distal end for attachment to wall bracket 26 and larger aperture 22*b* on the proximal end for attachment to stanchion 11. Wall brace 22 further includes notches 34 formed in each side proximate aperture 22*b* for receiving ridges 25 therein. During assembly wall brace 22 is positioned atop stanchion 11 whereby notches 34 easily align with ridges 25 for proper placement while aperture 22*b* aligns with threaded opening 21'. Thereafter screw 24 is threadably tightened therein and the distal end of wall brace 22 slid between projections 27, 27' whereby opening 30 is coincidental with aperture 22*a* so screw 29 can be threadably tightened therein. During placement, foot 23 is adjusted as described to account for uneven floors or the like.

A plurality of flat supports 31 or L-shaped supports 32 can be affixed to stanchions 11 for the desired look. Flat support 31 includes a pair of side by side apertures 31*b* on one end with notch 31*a* positioned therebetween on one side as seen in FIG. 7. During placement of flat support 31, notch 31*a* engages ridge 25 of stanchion 11 and flat support 31 fits flushly thereagainst whereby conventional machine screws 41 are positioned within apertures 31*b* and threadably tightened to stanchion 11 by serrations 20, 20' in U-shaped channels 19, 19'.

L-shaped support 32 includes a pair of side by side apertures 32*b* centrally formed in the vertical portion with notch 32*a* positioned therebetween on one side as seen in FIG. 7. Flat support 31 and L-shaped support 32 may be positioned on either side of stanchion 11 as desired. An opposing pair of apertures 32*c* are formed in the horizontal portion of L-shaped support 32 near the distal and proximal ends thereof. During placement of L-shaped support 32, notch 32*a* engages ridge 25 whereby L-shaped support 32 flushly fits against stanchion 11. Conventional machine screws 41 are then positioned within apertures 32*b* and threadably tightened to stanchion 11 by serrations 20, 20' in U-shaped channels 19, 19'. As would be understood screws 41 are long enough to fit within channels 19, 19' but do not penetrate or abut ends 19*a*, 19*a'* (FIG. 4).

Figure 8:
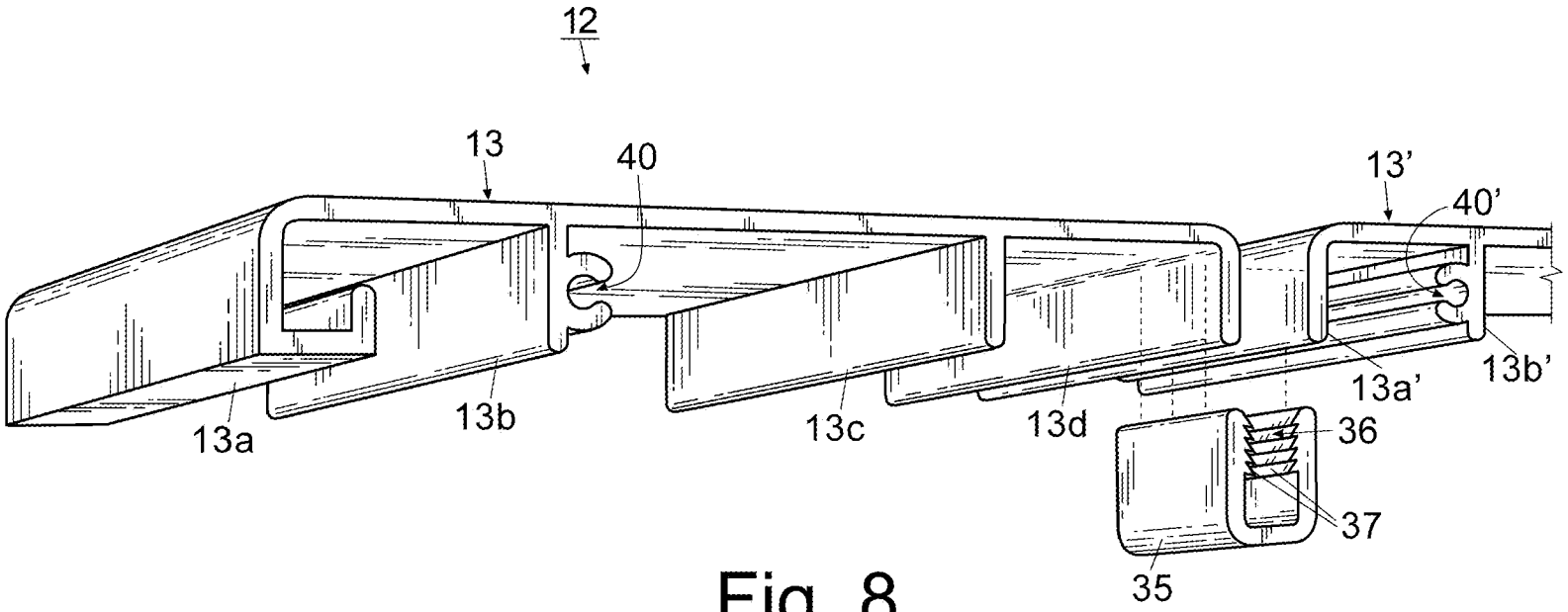
FIG. 8 demonstrates an enlarged perspective view of a partial pair of U-shaped lateral sections prior to assembly.

U-shaped lateral sections 13, 13' shown in FIGS. 6 and 8 are preferably formed from aluminum, however other suitable materials could also be used. Lateral section 13 is formed having an outer U-shape with legs 13*a*, 13*b*, 13*c* and 13*d*. Leg 13*a* is formed to include a squared C-shaped bottom whereas leg 13*b* is formed of a vertical wall having a rounded bottom and a cylindrical threaded C-shaped channel 40 formed on one side thereof. Legs 13*c* and 13*d* consist of vertical walls having rounded bottoms. Lateral section 13' is formed to include opposing outer vertical walls 13*a'* and a pair of inner vertical walls 13*b'* each having a rounded bottom and a cylindrical threaded C-shaped channel 40' formed on one side thereof preferably facing outer vertical walls 13*a'*. As seen in FIG. 6, lateral member 12 for example is formed by central U-shaped lateral section 13' having a U-shaped lateral section 13 on each side in mirrored relation. As seen in FIG. 8, U-shaped clip 35 includes cavity 36 and clip serrations 37 formed on the inside upper portion of each vertical wall. When joining lateral section 13 to lateral section 13', clip 35 is slidably received on and frictionally engages respectively walls 13*d* and 13*a'* for tight engagement thereto. Should it be desired for lateral member 12 to be wider a series of U-shaped lateral sections 13' would be centered between a pair of U-shaped lateral sections 13 and a plurality of clips 35 utilized for joining the respective sections together for durability and strength. In an alternate embodiment, lateral sections 13, 13' may come in large sections, for example twelve feet (12') lengths, and then cut as needed for appropriate size.

As seen in FIGS. 6 and 7, flat support 31 is shown along with L-shaped support 32 which can be selected for U-shaped lateral sections 13, 13' for load bearing purposes. The end of flat support 31 flushly aligns with T-side 17 of stanchion 11 whereas L-shaped support 32 extends on both sides of stanchion 11 (front and rear). For a finished shelf end, planar face plate 33 is applied to U-shaped lateral sections 13, 13' using screws 41 which are received within apertures 33*a* and into C-shaped channels 40, 40'. Face plate 33 includes an outwardly extending lip across the back thereof which rests slightly underneath lateral member 12 to assist in placement thereon. Face plate 33 adds additional strength and rigidity to lateral member 12 for completion of shelving 10.

Although not fully described as would be understood all openings and apertures described herein for receiving screws or other attaching means are tapered in order to countersink the screw heads therein to provide a flush finished appearance. Further depending on the particular look desired by the user, the required materials to form the shelving could be formed from aluminum or wood or a mix thereof, or could be special ordered to provide the aluminum with a specific color.

Thus, a wide variety of shelf designs such as shown in FIG. 1 can be constructed utilizing stanchions 11 and U-shaped lateral sections 13, 13' and the illustrations and examples provided herein are for explanatory purposes only and are not intended to limit the scope of the appended claims.

I claim:

1. Shelving system for attaching a shelf to a wall, the shelving system comprising:

an elongated stanchion spaced from the wall, said stanchion comprising a central section defining a ridge projection therealong, a pair of opposing T-sides, said pair of T-sides opposingly attached to said central section and each of said pair of T-sides defining a pair of U-shaped channels with said central section;

an L-shaped support rail including a notch that mates with said ridge projection of the stanchion;

a lateral member comprising an inverted U-shaped member, wherein the inverted U-shaped member is attached to said L-shaped support to form a shelf; a wall brace for attaching the stanchion to the wall, the wall brace extending between the stanchion and the wall, the wall brace includes a notch for receiving the ridge of the stanchion; and a wall bracket defining an opening for receiving a fastener and a pair of spaced projections, wherein said wall bracket is configured to be affixed to the wall and said wall brace is received between said pair of spaced projections to attach the stanchion to the wall.

2. The shelving of claim 1 wherein each of said pair of U-shaped channels comprise walls, said walls defining serrations therealong.

3. The shelving of claim 1 further comprising an adjustment member, said adjustment member attached to an end of said stanchion.

4. The shelving of claim 3 wherein said adjustment member comprises a threaded shaft, a base, said base attached to said threaded shaft.

5. The shelving of claim 1 further comprising a flat support, said flat support defining a notch, said flat support notch engaging said ridge.

6. The shelving of claim 1 further comprising a plurality of inverted U-shaped sections, and a plurality of clips, said plurality of clips each defining a serrated cavity, wherein corresponding serrated cavities engage corresponding inverted U-shaped sections.

7. Shelving system for attaching a shelf to a wall comprising a pair of spaced apart elongated stanchions, each of said stanchions comprising a pair of opposing T-sides, a central section defining a ridge projection therealong, each of said pair of T-sides attached to said central section, each of said pair of T-sides defining a pair of serrated U-shaped channels with said central section;

a pair of L-shaped support rails, each of said pair of L-shaped support rails opposingly positioned on different ones of said stanchions and includes a notch that mates with at least one of said stanchion central section ridges of a corresponding stanchion;

a lateral member comprising an inverted U-shaped member, said lateral member attached to each of said pair of L-shaped supports to form a shelf between said pair of stanchions;

a pair of wall braces, each of said pair of wall braces has a notch, each of said wall brace notches engaging different ones of said pair of stanchions;

and a pair of wall brackets each defining a pair of spaced projections for receiving a corresponding wall brace therebetween; wherein the wall braces each extend between corresponding stanchions and the respective wall brackets which are configured to be affixed to the wall in order to attach the corresponding stanchions to the wall.

8. The shelving of claim 7 further comprising a pair of adjustment members, each of said pair of adjustment members attached to different ones of said pair of stanchions.

9. The shelving of claim 7 further comprising a plurality of lateral members each defining a plurality of inverted U-shaped sections, said plurality of U-shaped sections joined one to another.

10. The shelving of claim 9 further comprising a plurality of clips, wherein corresponding clips engage corresponding adjacent inverted U-shaped sections.

* * * * *